US008454797B1

(12) United States Patent
Veverka et al.

(10) Patent No.: US 8,454,797 B1
(45) Date of Patent: Jun. 4, 2013

(54) PROCESS FOR INKJET PAPER AND PAPER PRODUCED THEREBY

(75) Inventors: Peter J. Veverka, Schroon Lake, NY (US); Thomas D. Ruch, Queensbury, NY (US)

(73) Assignee: Finch Paper LLC., Glens Falls, NY (US)

( * ) Notice: Subject to any disclaimer, the term of this patent is extended or adjusted under 35 U.S.C. 154(b) by 0 days.

(21) Appl. No.: 13/552,207

(22) Filed: Jul. 18, 2012

Related U.S. Application Data

(60) Provisional application No. 61/642,890, filed on May 4, 2012.

(51) Int. Cl.
*D21H 17/64* (2006.01)
*D21H 23/22* (2006.01)

(52) U.S. Cl.
USPC ..... 162/181.4; 162/135; 162/158; 162/181.1; 162/184

(58) Field of Classification Search
USPC ..... 162/135, 158, 181.1, 181.4, 184; 427/288
See application file for complete search history.

(56) References Cited

U.S. PATENT DOCUMENTS

| | | | | |
|---|---|---|---|---|
| 2,711,377 | A * | 6/1955 | Riddell | 428/498 |
| 3,565,681 | A * | 2/1971 | Walters et al. | 428/341 |
| 4,188,456 | A * | 2/1980 | Patel | 503/212 |
| 4,381,185 | A | 4/1983 | Swanson et al. | |
| 5,849,153 | A * | 12/1998 | Ishino et al. | 162/135 |
| 6,162,328 | A | 12/2000 | Cenisio et al. | |
| 6,207,258 | B1 | 3/2001 | Varnell | |
| 6,880,928 | B2 | 4/2005 | Hosoi et al. | |
| 7,018,459 | B2 | 3/2006 | Doi et al. | |
| 7,241,508 | B2 * | 7/2007 | Corrigan et al. | 428/532 |
| 7,367,666 | B2 | 5/2008 | Doi et al. | |
| 8,012,551 | B2 | 9/2011 | Song et al. | |
| 8,034,422 | B2 | 10/2011 | Dannhauser et al. | |
| 8,092,873 | B2 | 1/2012 | Wang et al. | |
| 2006/0051528 | A1 * | 3/2006 | Ogino et al. | 428/32.21 |
| 2007/0087138 | A1 | 4/2007 | Koenig et al. | |
| 2009/0258203 | A1 | 10/2009 | Aoyama et al. | |
| 2009/0317549 | A1 | 12/2009 | Tan et al. | |
| 2010/0045760 | A1 | 2/2010 | Kawakami et al. | |
| 2011/0001779 | A1 | 1/2011 | Kida | |
| 2011/0281042 | A1 | 11/2011 | Wild | |

FOREIGN PATENT DOCUMENTS

| | | |
|---|---|---|
| WO | 2009/095697 | 8/2009 |
| WO | 2010/001965 | 1/2010 |

OTHER PUBLICATIONS

Smook, Gary A., Handbook for Pulp and Paper Technologists, 2nd ed, Angus Wilde Publications, 1992, pp. 283-284.*

Ferguson, Robert J., Mineral Scale Prediction and Control at Extreme TDS, International Water Conference, Nov. 16, 2011, French Creek Software, Inc., Kimberton, PA.

Recovery of Caustic and Acids in the Dairy Industry, Application Bulletin, May 2012, Koch Membrane Systems, Inc., Wilmington, MA.

Gorenflo, Andreas et al., High pH operation in seawater reverse osmosis permeate: First results from the world's largest SWRO plant in Ashkelon, ScienceDirect, 2007, 80-90, Desalination 203, Elsevier B.V.

* cited by examiner

*Primary Examiner* — Mark Halpern
*Assistant Examiner* — Dennis Cordray
(74) *Attorney, Agent, or Firm* — Heslin Rothenberg Farley & Mesiti P.C.

(57) ABSTRACT

A method for improving the print quality of paper, a process for preparing such paper and the paper produced thereby are disclosed. The method involves applying to the paper an aqueous solution comprising 0.15 to 6 weight percent calcium in the form of its hydroxide. The supersaturated solution of calcium hydroxide can be obtained from reverse osmosis of milk of lime. The paper produced by the method disclosed exhibits a surface concentration of calcium greater than 3 $mg/m^2$ and less than 360 $mg/m^2$ and at the same time less than 20% of a halide, nitrate, sulfate, carbonate, acetate or formate counter ion.

5 Claims, 2 Drawing Sheets

Figure 1 – Configuration of Full Scale Plant for $Ca^{+2}$ Production from Milk of Lime

| Figure 2A – Sample B.1 – 75.7 mg/m$^2$ of $Ca^{+2}$ from $CaCl_2$ | Figure 2B – Sample B.3 –72.4 mg/m$^2$ of $Ca^{+2}$ from concentrated calcium hydroxide. |
| --- | --- |

PROCESS FOR INKJET PAPER AND PAPER PRODUCED THEREBY

CROSS-REFERENCE TO RELATED APPLICATIONS

This application claims priority from U.S. provisional application 61/642,890, filed May 4, 2012, the entire contents of which are incorporated herein by reference.

FIELD OF THE INVENTION

The invention relates to a method for improving the print quality of paper, a process for preparing such paper and the paper produced thereby.

BACKGROUND OF THE INVENTION

Inkjet printing has developed substantially in the last decade, facilitated by the rapid advancement in both printers and substrates. On the substrate side, papers specifically adapted to inkjet printing have been developed and patented. Among the well-known technologies for paper for inkjet printing is that associated with HP ColorLok® papers. One of the critical elements in the ColorLok® technology is the incorporation of a sufficiently high local concentration of divalent ions at the surface of the paper so as to quickly immobilize pigmented printing ink. This technology is set forth in some detail in U.S. Pat. No. 6,207,258. Among the preferred divalent cations for this purpose is $Ca^{+2}$.

Calcium carbonate is well-known in the industry for incorporation into paper to improve printing characteristics, but its solubility (0.0008 g/100 mL at 20° C.) requires that it be used as a suspension. Calcium carbonate is therefore commonly incorporated into the pulp slurry with the fiber. Its use in coatings that are applied to paper after the paper has been formed is complicated by the need to maintain the $CaCO_3$ particles in suspension and by the mechanical effects (abrasion) resulting from employing particles.

Conventionally, calcium chloride has been used as the source of $Ca^{+2}$ for surface treating paper because it is commercially available in bulk, and the solubility of $CaCl_2$ in water is 74.5 g/100 mL at 20° C. Other calcium salts that are disclosed for surface treating paper include calcium acetate, calcium formate, calcium bromide and calcium nitrate. Whether these salts are in actual commercial use is less clear, but they are at least disclosed in the literature, presumably because, if one ignores economic considerations, their solubilities (34.7 g/100 mL, 16.6 g/100 mL, 143 g/100 mL and 84.5 g/100 mL at 20° C., respectively) are sufficient to contemplate their use in solution.

Although calcium chloride is by far the most commonly used calcium source for surface treatment of inkjet papers, it is not without its drawbacks. Among the more prominent of these is the corrosive nature of calcium chloride solutions. This results in considerable damage to metallic parts. It would be desirable to find a practical source of soluble $Ca^{+2}$ that did not corrode metal parts in the papermaking machinery.

SUMMARY OF THE INVENTION

It has now been found that an adequate concentration of calcium for the surface treatment of paper can be achieved by preparing a supersaturated solution of calcium hydroxide. The supersaturated solution can be obtained from reverse osmosis (RO) of milk of lime.

In one aspect, the invention relates to a method for improving the print quality of paper comprising applying to the paper an aqueous solution comprising 0.15 to 6 weight percent calcium in the form of its hydroxide.

In another aspect, the invention relates to an aqueous solution comprising 0.15 to 6 weight percent calcium, in the form of its hydroxide, and at least one sizing agent.

In another aspect, the invention relates to a process for treating paper comprising:

(a) providing a paper substrate;

(b) applying to at least one surface of the paper substrate an aqueous solution comprising 0.15 to 6 weight percent calcium in the form of its hydroxide.

In another aspect, the invention relates to paper comprising:

(a) a cellulosic substrate having a plurality of edges and two faces;

(b) at least one of the faces exhibiting at its surface (i) a surface concentration of calcium (as $Ca^{+2}$) greater than 3 $mg/m^2$ and less than 360 $mg/m^2$ and (ii) less than 20% of said calcium surface concentration (in moles) of a counter ion other than 1. hydroxide,
2. bicarbonate,
3. a carboxylate of greater than 65 mol wt, and
4. a sulfonate of greater than 150 mol wt.

In another aspect, the invention relates to a dried cellulosic substrate for ink jet printing produced by the process of:

(a) treating a cellulosic substrate with an aqueous solution comprising 0.15 to 6 weight percent calcium in the form of its hydroxide; and (b) drying.

In another aspect, the invention relates to a method for utilizing effluent from slaking lime comprising:

(a) passing milk of lime through reverse osmosis to provide a high-calcium effluent that comprises greater than 5000 ppm $Ca^{+2}$ and less than 5000 ppm total halide, nitrate, sulfate and formate; and (b) applying said high-calcium effluent onto a cellulosic substrate.

DETAILED DESCRIPTION OF THE INVENTION

Figure 1:
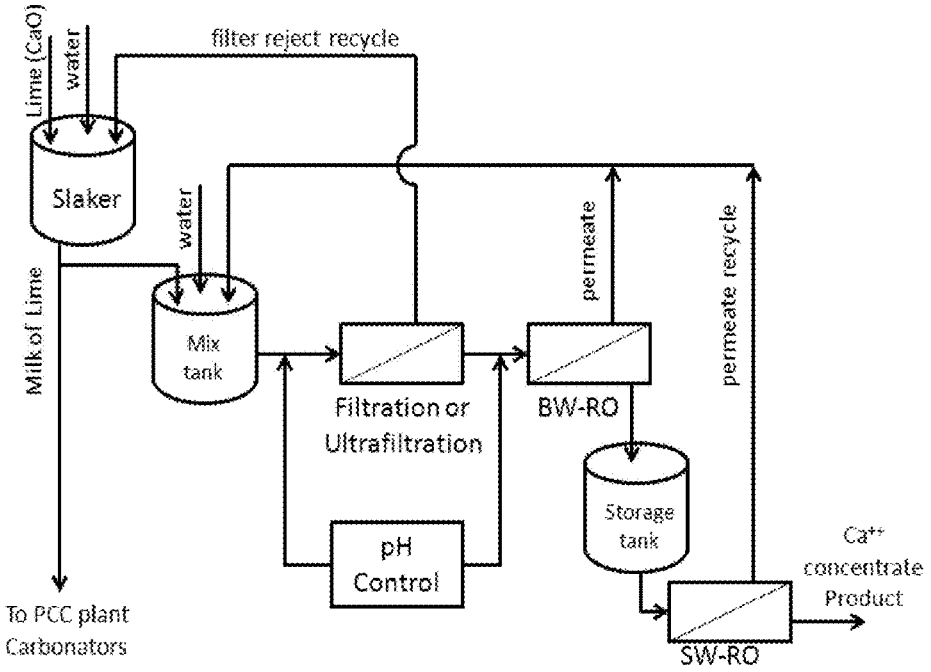
FIG. 1 is a schematic flow diagram of an apparatus for producing supersaturated calcium hydroxide solutions.

In a method aspect, the invention relates to a method for improving the print quality of paper comprising applying to the paper an aqueous solution comprising 0.15 to 6 weight percent calcium in the form of its hydroxide. In a composition aspect, the invention relates to an aqueous solution comprising 0.15 to 6 weight percent calcium, in the form of its hydroxide, and at least one sizing agent. Since calcium hydroxide has a molecular weight of 74.10, these solutions will comprise about 0.27 to 11.1 weight percent calcium hydroxide. In a process aspect, the invention relates to a process for treating paper comprising: (a) providing a paper substrate; and (b) applying to at least one surface of the paper substrate an aqueous solution comprising 0.15 to 6 weight percent calcium in the form of its hydroxide. In an article of manufacture aspect the invention relates to a dried cellulosic substrate for ink jet printing produced by the process of (a)

treating a cellulosic substrate with an aqueous solution comprising 0.15 to 6 weight percent calcium in the form of its hydroxide; and (b) drying. In one embodiment of each of the four foregoing aspects, the aqueous solution may comprise 0.15 to 1.0 weight percent calcium in the form of its hydroxide. In another embodiment of each of the four foregoing aspects, the aqueous solution may comprise 1.0 to 2.0 weight percent calcium in the form of its hydroxide. In another embodiment of each of the four foregoing aspects, the aqueous solution may comprise 1.0 to 3.0 weight percent calcium in the form of its hydroxide. In other embodiments the aqueous solution may comprise from 0.3 to 3 weight percent, from 0.5 to 3 weight percent or from 0.8 to 3 weight percent calcium in the form of its hydroxide.

In a further article of manufacture aspect, the invention relates to paper in which at least one of the two faces exhibits a surface concentration of calcium (as $Ca^{+2}$) greater than 3 mg/in$^2$ and less than 360 mg/m$^2$ and at the same time less than 20% of a counter ion other than (1) hydroxide, (2) bicarbonate, (3) a carboxylase of greater than 65 mol wt, and (4) a sulfonate of greater than 150 mol wt. For example, if the surface concentration of $Ca^{+2}$ is 100 mg/m$^2$, that equates to 2.5 millimoles of $Ca^{+2}$ per square meter. In that case, there cannot be more than 0.5 millimoles per square meter (17.8 mg/m$^2$) of chloride. However, there can be more than 0.5 millimoles per square meter of hydroxide. There can also be more than 0.5 millimoles per square meter of propionate but not acetate. Similarly, there can be more than 0.5 millimoles per square meter of dodecyl sulfonate but not benzenesulfonate. In a particular embodiment, there is less than 20% of the calcium surface concentration of halide, nitrate, sulfate, carbonate, acetate or formate counterion.

Traditionally, the term "concentration" is used to describe a measure of weight (or its equivalent in moles) per unit volume. However, in the paper art, the amount of a species that is often sought to be quantified is weight as a function of surface area. To avoid confusion, the term "concentration" as used herein will refer to weight per volume, and the term "surface concentration" will be reserved to refer to weight as a function of surface area.

The solubility of $Ca(OH)_2$ in water is 0.185 g/100 mL at 0° C., 0.165 g/100 mL at 20° C. and 0.077 g/100 mL at 100° C. At 20° C. a saturated solution of calcium hydroxide is 0.000234 M. This puts calcium hydroxide well outside the boundary of what would normally be considered a "water soluble" salt for the purposes of a surface coating solution in the paper industry. The proportion of $Ca^{+2}$ in $Ca(OH)_2$ is 54%. The concentration of $Ca(OH)_2$ at saturation ranges from 0.07% to 0.19% as an inverse function of temperature, and consequently the concentration of $Ca^{+2}$ derived from $Ca(OH)_2$ at saturation ranges from 0.04% by weight to 0.11% by weight. A solution of 1% to 6% by weight $Ca^{+2}$ in the form of $Ca(OH)_2$ is thus roughly an order of magnitude higher than can be obtained by slaking lime. As would be expected by the person of skill, such supersaturated solutions, if allowed to stand undisturbed for an extended period will begin to precipitate calcium hydroxide. In the case of the supersaturated solutions herein described, the clear or opalescent solutions begin to precipitate within a matter of a day or two, and, therefore, must be used shortly after they emerge from the reverse osmosis (RO) system.

Another aspect of the invention is a method for utilizing effluent from slaking lime. Many paper manufacturing operations include a lime-slaking component. Often this facility is used to provide precipitated calcium carbonate or as part of the kraft recovery cycle. In an embodiment, the processes described herein offer a way to utilize an existing facility to provide the starting material for the paper coating solution. According to this aspect, milk of lime is passed through reverse osmosis to provide a high-calcium effluent. An apparatus for carrying out this aspect of the invention is shown schematically in FIG. 1. An optional feature of the apparatus depicted in the figure is the return of the permeate to the mix tank, which avoids the production of a waste stream. Usually it will be desirable to filter the milk of lime before passing it into the RO system so as to make the osmosis more efficient. By suitable manipulation of power input and feedstock, the effluent from reverse osmosis can be driven to greater than 5000 ppm $Ca^{+2}$ while, at the same time maintaining less than 5000 ppm of any one of or the total, in combination, of: halide, nitrate, sulfate and formate. Outputs from RO are often given in ppm on a weight-per-volume basis, rather than weight percent. Since the density of water at 30° C. is 0.9957, weight per volume and weight percent are equivalent within the margin of error for most practical purposes, and 5000 ppm may be considered equal to 0.5 weight percent over the range of temperatures commonly encountered in the processes herein. Thus, for example, the concentrate from Osmo® TITAN-180 reverse osmosis system fed into SeaPro E-72 seawater system (GE Power and Water, Trevose, Pa. 19053) using clarified milk of lime will produce a supersaturated aqueous solution containing 12.9 g/L of Ca+2 and containing less than 0.01 g/L of chloride, about 2 g/L of carbonate and levels of nitrate and bromide below 0.00001 g/L. This data was compiled using WinFlows 3.1.1 with Database 3.0.3 (GE Power and Water, Trevose, Pa.), which is a free software program to simulate a configuration with variable operating conditions for a reverse osmosis system. In this particular simulation experiment, the first cycle of RO was carried out with a feed pressure of 9.9 bar and feed flow rate of 4,726 m$^3$/day (867 gpm). The concentrate from this cycle was returned to the seawater RO with a feed pressure of 25.5 bar and feed flow rate of 1,420 m$^3$/day (260 gpm) to produce a final stage effluent containing 12.9 g/L of $Ca^{+2}$ at 354.5 m$^3$/day (65 gpm). This RO effluent may then be combined with sizing, typically starch, at a roughly 1:1 ratio, and applied to paper by conventional means.

A milk of lime sample of $Ca(OH)_2$ produced from high calcium quicklime (CaO) (PCC Lime grade, Greymont Limited, Richmond, BC, Canada) was obtained from the reaction zone outlet on an industrial 2,270 kg/hour slaker. The solids were in the range from 22 to 23%. The sample was volumetrically diluted approximately 50:1 and pre-filtered with a 6.0 micron (No. 3 Whatman Qualitative, 24 cm.) 4 L vacuum filter flask. In order to produce a supersaturated 3,000-4,000 ppm $Ca^{+2}$ solution, a lab scale ZenoPure Ultra 35 reverse osmosis system (Zenon Membrane Solutions, Oakville, ON, Canada) was modified to produce only a permeate and concentrate from the filtered and diluted milk of lime. A low pressure micro-pump (Series GJ-N23-1/20$^{th}$ hp, Micropump Inc, Vancouver, Wash.) feeds a 0.2 micron pre-filter (Flowtrex Filter, GE Osmonics, Minnetonka, Minn., part#86512) used to prevent RO membrane fouling. The rotary vane positive displacement pump (Proton Series-2, 102A100R11BA200, Murfreesboro, Tenn.) can supply the RO at pressures up to 18 bar which is suitable for tap water and brackish water type membranes. The reverse osmosis membrane size in this system is the approximately 2.5 in. (61 mm) diameter×21 in. (533 mm) length (i.e, standard 2521 nomenclature) used in small scale micro-systems. The initial lab trials shown in Table I tested membranes for both a tap water (Dow FILMTEC™ TW30-2521, part#80639) and seawater (Dow FILMTEC™ SW30-2521, part#80734) which are rated for feed streams of 2,000 ppm and 32,000 ppm of NaCl respectively in the pH 2.0 to 11.0 range. Both of these membranes are polyamide thin film composites.

TABLE I

Reverse Osmosis Lab Experimental Data and Simulation

| | Membrane | | |
|---|---|---|---|
| | GU.032712.TW30.1 Dow FILMTEC ™ TW30-2521 | WinFlows 3..1.1 Simulauiton GE DESALT ® AG2540FM | GU.040512.SW30.1 Dow FILMTEC ™ SW30-2521 |
| Membrane Age (hours) | 0.0 | 0.0 | 0.0 |
| Membrane Area ($m^2$) | 1.21 | 2.69 | 1.21 |
| Inlet Temperature (C.) | 20.6 | *20.6 | 17.0 |
| Inlet pH | 11.98 | *10.99 | 12.65 |
| Inlet Conductivity (μmhos) | 4,814 | 3,091 | 8,625 |
| Inlet $Ca^{+2}$ (ppm) | 848.3 ± 10.8 | *848.3 | 854.0 ± 6.0 |
| Average membrane feed pressure (bar) | 17.8 | 15.9 | 18.1 |
| Average Permeate flow (L/hr) | 29.1 | 84.1 | 22.6 |
| Average Concentrate flow (L/hr) | 6.6 | 24.4 | 7.7 |
| Permeate flux (L/(hr $m^2$)) | 24.1 | 31.2 | |
| Average Recovery (%) | 81.5 | 77.5 | 74.3 |
| Average Permeate pH | 11.12 | 11.01 | 10.82 |
| Average Concentrate pH | 12.22 | 10.85 | 12.61 |
| Average Permeate Conductivity (μmhos) | 349 | 269 | 80 |
| Average Concentrate Conductivity (μmhos) | 13,940 | 9,250 | 11,636 |
| Final Concentrate $Ca^{+2}$ (ppm) | 3,560 ± 31 | 3,689 | 1,280 ± 72 |
| Run duration (minutes) | 31 | Simulation | 44 |

In Table I a simulation of the experimental data is provided using WinFlows 3.1.1 with Database 3.0.3. The DESAL AG2540FM (40" long) membrane was selected to simulate the TW30-2521 (21" long) membrane because the NaCl rejection rates are identical with the permeate flows double for the 40" vs. 21" long membrane. WinFlows 3.1.1 also calculates the scaling potential for a membrane with the Stiff Davis Index (SDI) and the Langmuir Saturation Index (LSI) which was exceeded for the experimental inlet pH and inlet $Ca^{+2}$ concentration of 848.3 ppm and pH=11.98 for experiment GU.032712.TW30.1. The program also warns when the normal membrane design limit of pH<11.0 is exceeded. The maximum recovery percentage that the WinFlows simulation could converge a solution was 77.5% versus the experimental value of 81.5%. The lower recovery rate is the main reason for the difference in the feed pressure by 1.9 bar between the experiment and simulation. As would be recognized by the artisan, present membrane technology makes the region from 3% to 6% aqueous solutions of $Ca^{++}$ not cost effective, but it is expected that future technological advances would make the high operating pressures more commercially attractive.

The concentration of soluble calcium was tested using the APHA Standard method for the examination of wastewater (3500-Ca EDTA Titrimetric Method) with a variable sample size of 0.25 to 10.0 mL to maintain the titrated calcium content in the 5 to 10 mg range stated by the method. A 0.01M EDTA titrant with Eriochrome Blue Black R was used, and the final titration volume measured to ±0.05 mL during the violet to blue color change with at least 3 replicates of each sample.

The concentrate from the RO experiment was distilled at 97.9 kPa applied vacuum to lower the boiling temperature of the supernatant material to 46.0°±1.0° C. By keeping the heating wall temperature low enough during the vacuum distillation, a minimal quantity of precipitate was formed on the flask wall which leads to a reduction in calcium yield. Final concentrations of the vacuum distilled solutions ranged from 9,589 to 20,687 ppm of $Ca^{+2}$.

The concentrated $Ca^{+2}$ supersaturated solutions from the vacuum distillations were used to prepare surface size coatings with the ingredients listed in Table II. The different formulations are given in Table III comparing the performance of the surface sizing using $CaCl_2$ versus a formulation of $Ca^{+2}$ concentrate.

TABLE II

Surface Sizing Components for Formulation

| Ingredient | Manufacturer | Solids % |
|---|---|---|
| Casco ™ Industrial Corn Starch, 0300720 | Corn Products International | 21% Target |
| Tinopal SPP-Z liquid Diamino stilbene disulphonic acid derivative | Ciba Specialty Chemicals Corporation | n.a. |
| Chromaset ® 800 Styrene acrylic copolymer | Hercules Incorporated | 33.8% |
| Calcium Chloride solution | Slack Chemical Corporation, Inc. | 35.0% |
| Calcium Chloride Anhydrous | Mallinckrodt Baker Inc. | 98.8% |

The surface sizing solution pH switches from the slightly acidic pH=5 to 6 range with $CaCl_2$ to basic when the supersaturated solution of $Ca^{+2}$ is used as a source of the divalent ion. The final surface concentration of $Ca^{+2}$ for ranged from 34.1 to 150.5 mg/$m^2$.

TABLE III

| Experimental Conditions | | | | | | | | | | | | | |
|---|---|---|---|---|---|---|---|---|---|---|---|---|---|
| | Experiment Designation | | | | | | | | | | | | |
| | A.0 | A.1 | A.2 | A.3 | A.4 | A.5 | B.1 | B.2 | B.3 | B.4 | C.1 | C.2 | C.3 |
| Distillation Concentrate Used to Dilute? | NO | NO | NO | Yes | Yes | Yes | NO | Yes | Yes | Yes | NO | Yes | Yes |
| Distilled Concentrate $Ca^{+2}$ ppm | — | — | — | 9,859 | 9,859 | 9,859 | — | 20,687 | 20,687 | 20,687 | — | 10,791 | 10,791 |
| Distilled Concentrate $Ca^{+2}$ wt % | — | — | — | 0.99 | 0.99 | 0.99 | — | 2.07 | 2.07 | 2.07 | — | 1.08 | 1.08 |
| Starch (g) | 50.0 | 50.0 | 50.0 | 50.0 | 50.0 | 50.0 | 50.0 | 50.0 | 50.0 | 50.0 | 50.0 | 50.0 | 50.0 |
| Starch wt % | 21.8 | 21.8 | 21.8 | 21.8 | 21.8 | 21.8 | n.d. | n.d. | n.d. | 19.9 | 19.9 | 19.9 | 19.9 |
| Starch dry (g) | 10.9 | 10.9 | 10.9 | 10.9 | 10.9 | 10.9 | 10.5 | 10.5 | 10.5 | 9.95 | 9.95 | 9.95 | 9.95 |
| $CaCl_2$ (g) - 36.4% solution | — | 4.81 | 4.81 | — | — | — | — | — | — | — | — | — | — |
| $CaCl_2$ (g) - 98.8% powder | — | — | — | — | — | — | 1.78 | — | — | — | 1.78 | — | — |
| $CaCl_{2\ (g)}$ - dry | — | 1.75 | 1.75 | 0.00 | 0.00 | 0.00 | 1.76 | 0.00 | 0.00 | 0.00 | 1.76 | 0.00 | 0.00 |
| Tinopal SPZ liquid (g) | — | | 1.18 | — | 1.18 | — | — | — | — | — | — | — | — |
| Chromaset CS800 - 33.8% (g) | — | 0.30 | 0.30 | 0.26 | 0.26 | 0.26 | 0.30 | 0.26 | 0.26 | 0.26 | 0.30 | 0.26 | 0.26 |
| Chromaset CS800 (g) dry | — | 0.101 | 0.101 | 0.088 | 0.088 | 0.088 | 0.101 | 0.088 | 0.088 | 0.088 | 0.101 | 0.088 | 0.088 |
| Distilled Water (g) | 45.54 | 57.19 | 57.19 | — | — | 21.4 | 60.2 | — | 23 | 11.5 | 60.2 | | 23 |
| Concentrate $Ca^{+2}$ solution (g) | — | — | — | 46.0 | 46.0 | 24.6 | — | 46.0 | 23.0 | 11.5 | | 46.0 | 23.0 |
| Concentrate $Ca^{+2}$ dry (g) | 0.00 | 0.00 | 0.00 | 0.45 | 0.45 | 0.24 | 0.00 | 0.95 | 0.48 | 0.24 | 0.00 | 0.50 | 0.25 |
| Total Dry Weight (g) | 10.90 | 12.75 | 12.75 | 11.44 | 11.44 | 11.23 | 12.36 | 11.54 | 11.06 | 10.28 | 11.81 | 10.53 | 10.29 |
| Total Mmoles as $Ca^{+2}$ | 0.00 | 15.78 | 15.78 | 11.32 | 11.32 | 6.05 | 15.85 | 23.74 | 11.87 | 5.94 | 15.85 | 12.39 | 6.19 |
| Dry wt % as $Ca^{+2}$ | 0.00 | 4.96 | 4.96 | 3.96 | 3.96 | 2.16 | 5.14 | 8.25 | 4.30 | 2.32 | 5.38 | 4.71 | 2.41 |
| Final Solids % | 12.2 | 12.2 | 12.2 | 13 | 12.9 | 12.3 | 11.1 | 13.6 | 12.6 | 11.1 | 11.1 | 11.9 | 11.1 |
| Density of sample (g/cc) | 1.050 | 1.050 | 1.050 | 1.053 | 1.053 | 1.050 | 1.045 | 1.056 | 1.052 | 1.045 | 1.045 | 1.049 | 1.045 |
| Final pH | n.d. | n.d. | n.d. | n.d. | n.d. | n.d. | 5.1 | 10.3 | 10 | 11.1 | 4.8 | 10.5 | 9.5 |
| Dry Coatweight (gsm) | 1.63 | 1.63 | 1.63 | 1.74 | 1.73 | 1.64 | 1.47 | 1.82 | 1.68 | 1.47 | 1.47 | 1.59 | 1.47 |
| Surface Concentration $Ca^{+2}$ $mg/m^2$ | 0.0 | 80.7 | 80.7 | 69.0 | 68.4 | 35.4 | 75.7 | 150.5 | 72.4 | 34.1 | 79.3 | 74.7 | 35.6 |

The surface sizing solutions in Table III were applied to a 75 gsm internally sized paper with characteristics in Table N. The filler was contributed by 24.9% $CaCO_3$ and 2.3% other inorganics. A No. 5 wire wound drawdown rod (Part 55305, Diversified Enterprises, Claremont, N.H.) was used to apply the surface sizing solution to the paper substrate for multiple samples of each experimental condition. The sheets were then allowed to air dry unrestrained for 10-20 minutes and then processed in a rotary handsheet dryer at 120° C.

TABLE IV

| Paper Properties for Lab Drawdown Experiments | | |
|---|---|---|
| Property | Value | Method |
| Basis weight (gsm) | 74.3 | TAPPI 410 om-98 |
| Porosity | 13 | TAPPI 530 om-96 |
| Ash % (525° C.) | 27.2 | TAPPI 413 om-93 |
| Brightness | 87.8 | TAPPI 452 om-97 |
| Opacity | 93.7 | TAPPI 525 om-96 |
| Gurley Stiffness (MD) | 146 | TAPPI 543 on-94 |
| Gurley Stiffness (CD) | 53 | TAPPI 543 om-94 |

In Table V the print properties on four different models of desktop pigmented inkjet printers are presented. Print density was measured with an X-Rite SpectroEye LT (Model 36.64.00, x-Rite, Regensdorf, Switzerland) and the dot gain calculated using the Murray-Davies formula. The manufacturers' original inkjet cartridges were used on the printers. The Inkjet Test Target (720 dpi) (PDF File, ImageXpert Inc., Nashua, N.H.) was used on the C88+ and C120 while the Excel based 1× Test Target 8a (Excel File, ImageXpert Inc., Nashua, N.H.) was used on the HP B9180 printer. The Kodak Scripting Interface (Kodak file format, Eastman Kodak Company, Rochester, N.Y.) was used with the Kodak ESP 3250. Both the ESP3250 and B9180 will print in pure single color mode with the test patterns that were used while the other printers had rendering artifacts even with the color management turned off. Details of the printers and files are given in Table VI.

TABLE V

Print Density on Desktop Printer Platforms

| | Experiment Designation | | | | | | | | | | | | |
|---|---|---|---|---|---|---|---|---|---|---|---|---|---|
| | A.0 | A.1 | A.2 | A.3 | A.4 | A.5 | B.1 | B.2 | B.3 | B.4 | C.1 | C.2 | C.3 |
| Surface Concentration Ca++ mg/m2 | — | 80.7 | 80.7 | 69.0 | 68.4 | 35.4 | 75.7 | 150.5 | 72.4 | 34.1 | 79.3 | 74.7 | 35.6 |
| Kodak 3250 | | | | | | | | | | | | | |
| 100% Cyan | 0.96 | 0.96 | 0.96 | 0.92 | 0.92 | 0.92 | 0.96 | 0.98 | 1.01 | 1.03 | 1.02 | 1.07 | 0.93 |
| 100% Magenta | 0.74 | 0.75 | 0.71 | 0.71 | 0.72 | 0.72 | 0.72 | 0.71 | 0.74 | 0.76 | 0.76 | 0.81 | 0.76 |
| 100% Yellow | 0.64 | 0.86 | 0.87 | 0.82 | 0.82 | 0.80 | 0.88 | 0.88 | 0.87 | 0.83 | 0.88 | 0.88 | 0.83 |
| 100% Black | 0.89 | 0.93 | 0.89 | 0.86 | 0.87 | 0.87 | 0.90 | 0.90 | 0.93 | 0.95 | 0.96 | 0.99 | 0.85 |
| 272% Graphic Black | 0.70 | 1.22 | 1.17 | 1.15 | 1.13 | 1.02 | 1.20 | 1.20 | 1.19 | 1.14 | 1.23 | 1.25 | 1.09 |
| 50% Cyan | 0.65 | 0.63 | 0.62 | 0.60 | 0.62 | 0.63 | 0.65 | 0.64 | 0.67 | 0.68 | 0.67 | 0.72 | 0.64 |
| Cyan Dot Gain % | 35.1 | 32.7 | 32.5 | 34.0 | 34.7 | 34.7 | 35.3 | 33.5 | 35.1 | 34.8 | 36.0 | 36.4 | 35.3 |
| Epson Stylus C88+ | | | | | | | | | | | | | |
| 100% Cyan | 0.92 | 0.95 | 0.89 | 0.93 | 0.91 | 0.93 | 0.92 | 0.98 | 0.96 | 0.98 | 0.97 | 0.99 | 0.94 |
| 100% Magenta | 0.87 | 1.03 | 0.96 | 0.99 | 0.96 | 0.96 | 0.98 | 1.03 | 0.97 | 1.01 | 1.04 | 1.04 | 0.98 |
| 100% Yellow | 0.72 | 0.79 | 0.72 | 0.77 | 0.71 | 0.73 | 0.73 | 0.76 | 0.76 | 0.78 | 0.78 | 0.76 | 0.76 |
| 100% Black | 1.27 | 1.29 | 1.21 | 1.24 | 1.21 | 1.22 | 1.20 | 1.28 | 1.23 | 1.26 | 1.28 | 1.30 | 1.27 |
| Graphic Black | 1.26 | 1.31 | 1.24 | 1.21 | 1.21 | 1.21 | 1.21 | 1.28 | 1.23 | 1.27 | 1.29 | 1.27 | 1.26 |
| 50% Cyan | 0.59 | 0.55 | 0.52 | 0.55 | 0.54 | 0.57 | 0.53 | 0.57 | 0.56 | 0.61 | 0.59 | 0.59 | 0.60 |
| HP B9180 | | | | | | | | | | | | | |
| 100% Cyan | | | | | | | 0.60 | 0.58 | 0.60 | 0.63 | 0.62 | 0.62 | 0.62 |
| 100% Magenta | | | | | | | 0.83 | 0.82 | 0.82 | 0.88 | 0.87 | 0.87 | 0.86 |
| 100% Yellow | | | | | | | 0.90 | 0.92 | 0.89 | 0.91 | 0.95 | 0.95 | 0.92 |
| 100% Black | | | | | | | 1.26 | 1.24 | 1.24 | 1.30 | 1.30 | 1.31 | 1.27 |
| 50% Cyan | | | | | | | 0.36 | 0.35 | 0.36 | 0.39 | 0.37 | 0.38 | 0.38 |
| Cyan Dot Gain % | | | | | | | 21.0 | 20.3 | 21.4 | 23.9 | 21.8 | 23.1 | 23.0 |
| Epson Stylus C120 | | | | | | | | | | | | | |
| 100% Cyan | | | | | | | 0.77 | 0.76 | 0.78 | 0.85 | 0.83 | 0.84 | 0.85 |
| 100% Magenta | | | | | | | 1.00 | 0.98 | 0.99 | 1.09 | 1.06 | 1.06 | 1.08 |
| 100% Yellow | | | | | | | 0.91 | 0.91 | 0.92 | 0.97 | 0.96 | 0.97 | 0.97 |
| 100% Black | | | | | | | 1.18 | 1.15 | 1.17 | 1.28 | 1.26 | 1.26 | 1.28 |

TABLE VI

Desktop Inkjet Printers and Settings

| Printer | Test Pattern | Driver Version | Printer Settings |
|---|---|---|---|
| EPSON Stylus C88+ | Inkjet Test Target | 5.51 | Plain Paper/Normal |
| EPSON Stylus C120 | Inkjet Test Target | 6.51 | Plain Paper/Photo |
| HP PhotoSmart Pro B9180 | IX Test Target 8a | 7.19.2006 | |
| Kodak ESP 3250 | Linear-4ch | 5.19.0.762 | Device level interface |

The samples A.1, A.2, B.1 and C.1 are all control conditions with surface concentrations of 75.7 to 80.7 mg/m$^2$ of $Ca^{+2}$ added as $CaCl_2$ as either dry powder or a concentrated solution. Condition A.0 is the starch only blank with a zero $Ca^{+2}$ surface concentration. The most dramatic effect that is seen consistently across all the printer platforms is that the experimental conditions with supersaturated aqueous solution (obtained in this instance by vacuum distillation rather than second stage RO) added as the source of $Ca^{+2}$ have equivalent densities. The example for the 272% halftone print coverage on a composite black for the Kodak ESP 3250 printer combines the data sets for the $CaCl_2$ control conditions with the $Ca^{+2}$ concentrate added to the surface sizing conditions. For this particular inkjet printer the print density on the composite black begins to plateau at surface concentrations above 100 mg/m$^2$ of $Ca^{+2}$ which is equivalent to a surface concentration of 221.5 mg/m$^2$ of $CaCl_2$. In Table V the effect of the $Ca^{+2}$ surface concentration on the Kodak ESP 3250 printer is not as evident for the other printing inks (cyan, magenta and yellow) until the total print coverage is greater than 200%. As the print coverage increases, the effect of the available excess $Ca^{+2}$ becomes more prominent.

The experimental conditions A.0 to A.5 from Table III were designed to compare the quenching effect of a $Ca^{+2}$ saturated solution versus $CaCl_2$ for brightness and whiteness development. The Tinopal SPP-Z OBA that was tested for these conditions was of the disulphonated type and is normally added at 1 to 5 kg/ton at the size press to improve brightness and whiteness of the sheet.

The brightness in Table VII was measured with a S4-M Brightimeter (Technidyne Corporation, New Albany, Ind.) which can measure a UV excluded brightness and thus determine the contribution by the OBA. The paper shade (L*, a*, b*) and whiteness were measured using a Technidyne Color Touch. The boost in whiteness from OBA between A.1 and A.2 was 23.4 points while between condition A.3 and A.4, a 28.2 point change was observed at the same ratio of starch to optical brightener. Another effect that is seen by using $Ca^{+2}$ concentrate as the source of the divalent cation, is that the blank control, A.0, and condition A.3, have a minimal shade difference with $\Delta E=0.38$ compared to sample A.1 vs. A.0 which has a $\Delta E=0.91$ when using $CaCl_2$. The formula for $\Delta E$ is the $\sqrt{(L_1^*-L_2^*)^2+(a_1^*-a_2^*)^2+(a_1^*-b_2^*)^2}$ and it is generally accepted that when it exceeds 1.0 that two samples are visually different.

TABLE VII

OBA Interaction with $CaCl_2$ and $Ca^{+2}$ Solutions

| Condition | $CaCl_2$ | OBA | $Ca^{+2}$ mg/m$^2$ | TAPPI Brightness with UV | Whiteness D65/10° | L* | a* | b* |
|---|---|---|---|---|---|---|---|---|
| A.0 | No | No | 0 | 87.0 | 93.9 | 94.99 | 0.12 | 0.09 |
| A.1 | Yes | No | 80.7 | 85.8 | 98.7 | 94.34 | 0.27 | −0.52 |
| A.2 | Yes | Yes | 80.7 | 89.6 | 120.2 | 95.17 | 0.947 | −2.59 |
| A.3 | No | No | 69.0 | 86.1 | 92.1 | 95.01 | 0.058 | 0.46 |
| A.4 | No | Yes | 68.4 | 89.5 | 120.3 | 95.19 | 1.01 | −2.58 |
| A.5 | No | No | 35.4 | 86.0 | 97.1 | 94.87 | 0.23 | −0.27 |

The experimental conditions B.1 to B.4 and C.1 to C.3 were designed to look directly at both a higher and lower surface concentration of $Ca^{+2}$ when compared to $CaCl_2$ without OBA added to surface sizing formulation. The two experimental series (B and C) used calcium concentrates produced from different vacuum distillations. At equal to slightly lower surface concentrations of $Ca^{+2}$, the use of $Ca^{+2}$ concentrate produced from reverse osmosis and vacuum distilled resulted in an equal to higher print density across all printer platforms. An outstanding example is C.2 in which the distillation was carried out by taking the 1000 mL distillation flask and boiling under vacuum to 50% level, adding reverse osmosis concentrate up the 100% level and resuming the distillation to approximately 25% volume. Sample C.2 has a surface concentration of 74.7 mg/m$^2$ of $Ca^{+2}$ which is slightly lower than the control C.1 at 79.3 mg/m$^2$. Nevertheless, condition C.2 has a higher print density by 0.0 to 0.05 units in print density on the Kodak ESP 3250 printer. This effect, although evident with the other printer platforms, is not as dramatic when compared to data from the Kodak ESP 3250.

Figure 2:
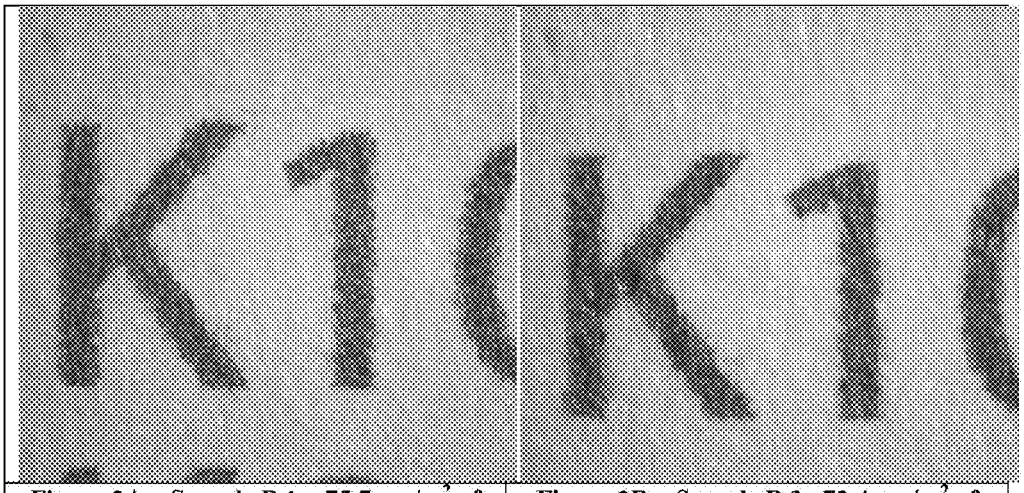
FIG. 2 is a comparison of two grey-scale renderings of test prints, one according to the art (FIG. 2A) and one depicting an embodiment of the invention (FIG. 2B).

The image resolution for a $Ca^{+2}$ concentrate compared to $CaCl_2$ is also equivalent. For samples B.1 and B.2 the printed area for black text on yellow background was measured using the Image Pro Plus (V 5.1, Media Cybernetics, Silver Springs, Md.) image analysis software at 18.3× magnification. Table VIII displays the technique variability for the measurement technique with the single sample standard deviation less than the condition standard deviation. Comparisons of the image for B.1 and B.3 are seen in FIGS. 2A and 2B.

TABLE VIII

Image Analysis Data on Sample B.1 and B.3

| Condition | Sample | K (pixels) | 1 (pixels) | Total K + 1 |
|---|---|---|---|---|
| B.1 | 1 - replicate 1 | 153,521 | 66,415 | 219,936 |
| B.1 | 1 - replicate 2 | 154,851 | 66,743 | 221,594 |
| B.1 | 1 - replicate 3 | 153,251 | 65,989 | 219,240 |
| | Single sample average | 153,874 | 66,382 | 220,257 |
| | Single sample standard deviation | 857 | 378 | 1,209 |
| B.1 | 2 | 152,029 | 64,869 | 216,898 |
| B.1 | 3 | 150,230 | 63,526 | 213,756 |
| | Condition Average | 152,776 | 65,508 | 218,285 |
| | Condition standard deviation | 1,741 | 1,315 | 3,042 |
| B.3 | 1 | 148811 | 67311 | 216,122 |
| B.3 | 2 | 154063 | 65876 | 219,939 |
| B.3 | 3 | 151961 | 64931 | 216,892 |
| | Condition Average | 151,612 | 66,039 | 217,651 |
| | Condition standard deviation | 2,643 | 1,198 | 2,019 |

The method of the invention allows one to improve the inkjet print quality of paper without affecting the offset lithography printing of the paper.

The invention claimed is:

1. A process for treating paper comprising:

(a) providing a paper substrate;

(b) applying to at least one surface of said paper substrate a supersaturated aqueous solution comprising 0.15 to 6 weight percent calcium in the form of its hydroxide.

2. A process according to claim 1 wherein said supersaturated aqueous solution comprises 0.15 to 3.0 weight percent calcium in the form of its hydroxide.

3. A process according to claim 1 wherein said supersaturated aqueous solution comprises 0.15 to 1.0 weight percent calcium in the form of its hydroxide.

4. A process according to claim 1 wherein said supersaturated aqueous solution comprises 1.0 to 2.0 weight percent calcium in the form of its hydroxide.

5. A process according to claim 1 wherein said supersaturated aqueous solution comprises 1.0 to 3.0 weight percent calcium in the form of its hydroxide.

* * * * *